US005794467A

United States Patent [19]

Justice

[11] Patent Number: 5,794,467

[45] Date of Patent: Aug. 18, 1998

[54] SECURITY DOOR REPLACEMENT

[76] Inventor: Ronny E. Justice, 572 Harolds Branch Rd., Pikeville, Ky. 41501

[21] Appl. No.: 846,538

[22] Filed: Apr. 29, 1997

[51] Int. Cl.[6] ..... E05B 63/14

[52] U.S. Cl. ..... 70/118; 292/34; 292/37; 292/39; 292/170; 292/182

[58] Field of Search ..... 292/170, 182, 292/166, 129, 37, 39, 34, 33, 32, 35, 41, 179, 36, 142; 70/103, 118–120, DIG. 80

[56] References Cited

U.S. PATENT DOCUMENTS

| | | | |
|---|---|---|---|
| 222,745 | 12/1879 | Simpson | 292/37 |
| 609,416 | 8/1898 | Damon | 292/170 X |
| 932,330 | 8/1909 | Rotchford | 292/33 X |
| 1,179,731 | 4/1916 | McDonald | 292/39 |
| 2,486,460 | 11/1949 | Bonenberger | 292/34 |
| 2,707,797 | 5/1955 | Juhlin et al. | 292/182 X |
| 2,973,984 | 3/1961 | Burke | 292/182 |
| 3,158,217 | 11/1964 | Johnson | 292/33 X |
| 3,545,799 | 12/1970 | Gertsfeld | 292/34 |
| 3,792,884 | 2/1974 | Tutikawa | 292/179 X |
| 4,678,213 | 7/1987 | Brasuell et al. | 292/37 |
| 5,067,755 | 11/1991 | James | 292/33 |
| 5,088,776 | 2/1992 | James | 292/33 |

FOREIGN PATENT DOCUMENTS

| | | | |
|---|---|---|---|
| 3330787 | 3/1985 | Germany | 292/33 |
| 14695 | 11/1885 | United Kingdom | 292/170 |
| 207081 | 11/1923 | United Kingdom | 292/182 |
| 495196 | 11/1938 | United Kingdom | 292/182 |

*Primary Examiner*—Lloyd A. Gall

[57] ABSTRACT

A security door replacement for increasing the security of homes or other structures includes a security door locking mechanism having a piston centrally located parallel to a longitudinal axis of the door. The piston has wedge shaped components on either end which interact with four locking arms. The security door replacement also includes a pinion gear connected to the door's doorknob which interacts with a rack gear integral to the central piston such that turning the doorknob causes the pinion gear to turn resulting in movement of the piston. This piston movement causes the locking arms to alternatively extend through and withdraw from the door frame and supporting structure thereby locking and unlocking the door.

7 Claims, 3 Drawing Sheets

SECURITY DOOR REPLACEMENT

BACKGROUND OF THE INVENTION

1. Field of the Invention

The present invention relates to a security door lock assembly and more particularly pertains to a new Security Door Replacement for increasing security for homes or other structures.

2. Description of the Prior Art

The use of security door lock assemblies is known in the prior art. More specifically, security door lock assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art security door lock assemblies include U.S. Pat. No. 5,410,900; U.S. Pat. No. 5,375,894; U.S. Pat. 4,754,715; U.S. Pat. No. 4,468,943 and U.S. Pat. No. 4,107,968.

While these devices fulfill their respective, particular objectives and requirements, the aforementioned patents do not disclose a new Security Door Replacement. The inventive device includes a security door locking mechanism having a piston centrally located parallel to a longitudinal axis of a door. The piston has wedge shaped components on either end which interact with four locking arms. The present invention also includes a means by which the piston is moved which causes the locking arms to engage and disengage latch plates mounted in a door frame and further travel through the jamb into the structural framing or block.

In these respects, the Security Door Replacement according to the present invention substantially departs from the conventional concepts and designs of the prior art, and in so doing provides an apparatus primarily developed for the purpose of increasing security of homes and other structures.

SUMMARY OF THE INVENTION

In view of the foregoing disadvantages inherent in the known types of security door lock assemblies now present in the prior art, the present invention provides a new Security Door Replacement construction wherein the same can be utilized for increasing security of homes or other structures.

The general purpose of the present invention, which will be described subsequently in greater detail, is to provide a new Security Door Replacement apparatus and method which has many of the advantages of the security door lock assemblies mentioned heretofore and many novel features that result in a new Security Door Replacement which is not anticipated, rendered obvious, suggested, or even implied by any of the prior art security door lock assemblies, either alone or in any combination thereof.

To attain this, the present invention generally comprises a security door locking mechanism made up of a piston centrally located parallel to the longitudinal axis of a door. The piston has wedge shaped components on either end which interact with four locking arms. The present invention also include a means by which the piston is moved causing the locking arms to engage and disengage latch plates mounted in a door frame and further travel through the jamb into the structural framing or block.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Security Door Replacement apparatus and method which has many of the advantages of the security door lock assemblies mentioned heretofore and many novel features that result in a new Security Door Replacement which is not anticipated, rendered obvious, suggested, or even implied by any of the prior art security door lock assemblies, either alone or in any combination thereof.

It is another object of the present invention to provide a new Security Door Replacement which may be easily and efficiently manufactured and marketed.

It is a further object of the present invention to provide a new Security Door Replacement which is of a durable and reliable construction.

An even further object of the present invention is to provide a new Security Door Replacement which is susceptible of a low cost of manufacture with regard to both materials and labor, and which accordingly is then susceptible of low prices of sale to the consuming public, thereby making such Security Door Replacement economically available to the buying public.

Still yet another object of the present invention is to provide a new Security Door Replacement which provides in the apparatuses and methods of the prior art some of the advantages thereof, while simultaneously overcoming some of the disadvantages normally associated therewith.

Still another object of the present invention is to provide a new Security Door Replacement for increasing security of homes or other structures.

Yet another object of the present invention is to provide a new Security Door Replacement which includes a unique and simple security door locking mechanism made up of a piston centrally located parallel to a longitudinal axis of the door. The piston has wedge shaped components on either end which interact with four locking arms. The present invention also include a means by which the piston is moved which causes locking arms to engage and disengage latch plates mounted in a door frame and further travel through the frame into the structural framing or block.

Still yet another object of the present invention is to provide a new Security Door Replacement that is easily locked and unlocked. This decreases the possibility of individuals being trapped inside a burning building having a security door with a more complicated locking mechanism.

Even still another object of the present invention is to provide a new Security Door Replacement that is more difficult to force open than traditional doors.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
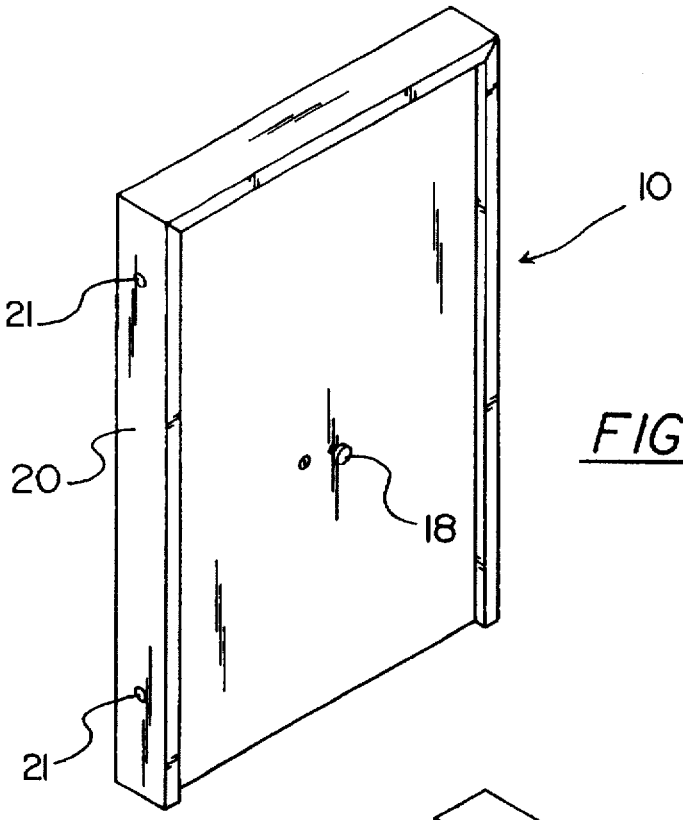
FIG. 1 is a perspective view of the exterior side of a new Security Door Replacement according to the present invention, particularly illustrating the door mounted in a door frame.

With reference now to the drawings, and in particular to FIGS. 1 through 6 thereof, a new Security Door Replacement embodying the principles and concepts of the present invention and generally designated by the reference numeral 10 will be described.

More specifically, it will be noted that the Security Door Replacement 10 comprises a door member having peripheral edges 11 for mounting in a door frame with an interior space and having a longitudinal axis, a centrally located piston 12, four locking arms 14, a means for moving the piston 17, and a means for locking the piston in position.

Figure 2:
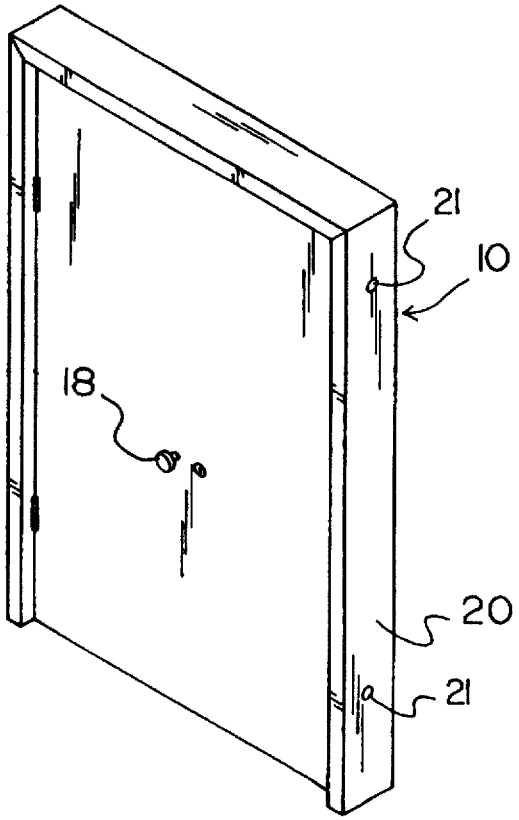
FIG. 2 is a perspective view of the interior side thereof.

As best illustrated in FIGS. 1 and 2, the present invention looks like a conventional door with the doorknob 18 positioned in the center of the door.

Figure 4:
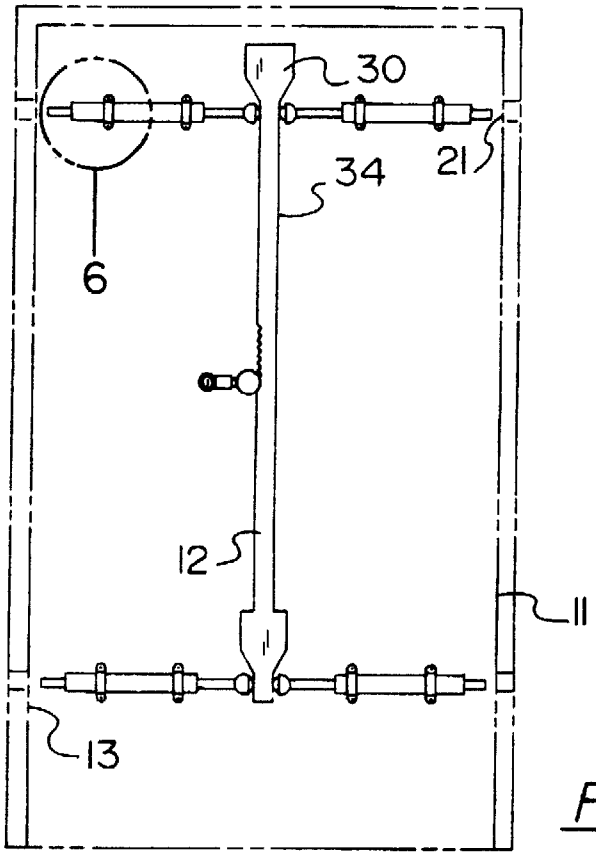
FIG. 4 is a fragmentary view of the locking mechanism when the door is unlocked.
Figure 3:
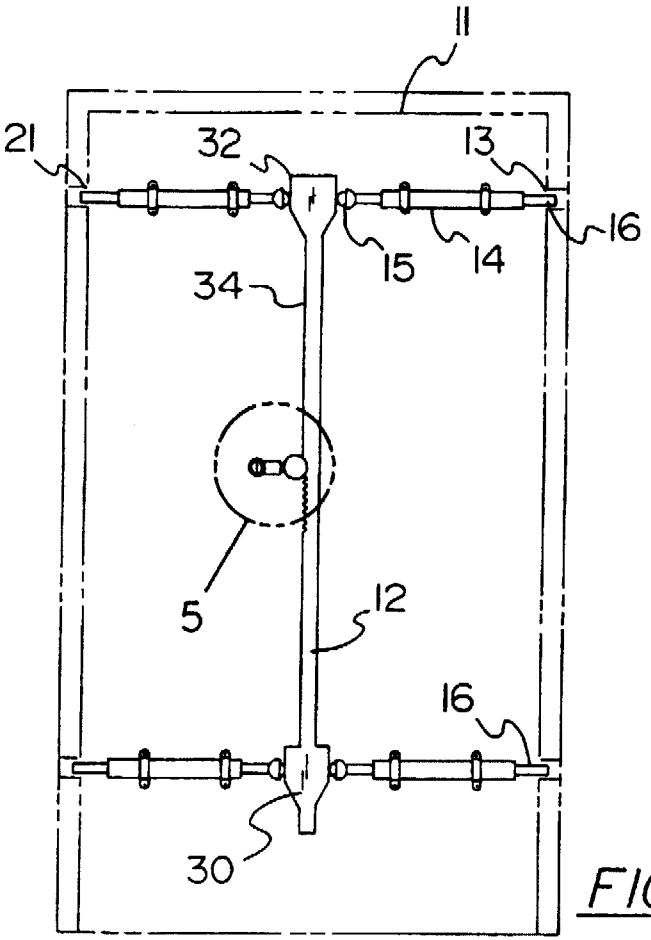
FIG. 3 is a fragmentary view of the locking mechanism when the door is locked.

FIGS. 3 and 4 show the piston 12 mounted in the interior of the door 10 and being oriented substantially parallel to a longitudinal axis of the door 10. They also show the locking arms 14 mounted in the interior of the door 10 and extending laterally outward from the piston 12. Each piston has an outside end 16 and an inside end 15. The locking arms 14 are mounted in a manner permitting movement in a lateral direction. The inside ends 15 of the locking arms 14 are positioned to interact with the wedge-shaped portions 30 of the piston 12 such that a sliding longitudinal motion of the piston results in lateral inward and outward movement of the locking arms 14. FIG. 3 shows the piston 12 with its narrow portions 34 and wedge-shaped portions 30 positioned such that the inside ends 15 of the locking arms 14 are engaging the wedge-shaped portions 30. In this configuration, the outside ends 16 of the locking arms 14 have passed through apertures 13 formed in the peripheral edges 11 of the door 10 and are engaging apertures 21 which extend through the door frame 20 to engage the door's structural framing or block, and the door 10 is secured in a closed position relative to the door frame 20 and the structural framing or block. FIG. 4 shows the central piston 12 positioned such that the inside ends 15 of the locking arms 14 are engaging the narrow portions 34 of the piston 12. In this configuration, the outside ends 16 of the locking arms 14 are not engaging the apertures 21 in the door frame 20, and the door 10 is not secured in a closed position relative to the door frame 20.

Figure 5:
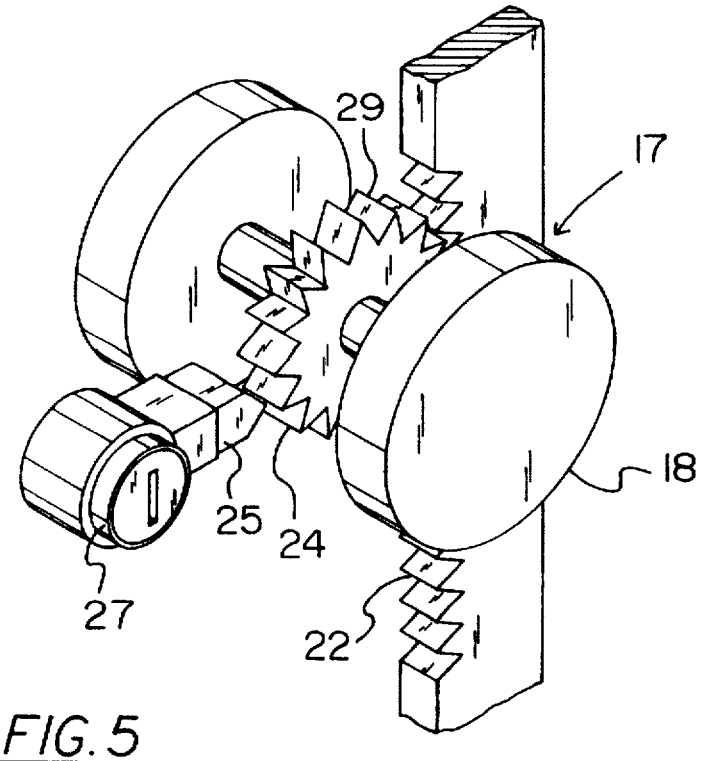
FIG. 5 is an exploded view of the means by which the central piston is moved.

FIG. 5 shows the means 17 by which the central piston 12 is moved. A rack style gear 22 is incorporated into one side of the central piston 12 and interacts with a pinion gear 24. The pinion gear 24 is connected to the doorknob 18 such that turning the doorknob 18 results in a movement of the central piston 12. Movement of the piston 12 causes the inside ends 15 of the locking arms 14 to alternatively engage the narrow portions 34 and wedge-shaped portions of the piston 12 resulting in lateral inward and outward motion of the locking arms 14. Also shown in FIG. 5 is a means for locking the pinion gear 24 against rotation thereby reversibly fixing the piston 12 in position with the outside ends 16 of the locking arms 14 extending through the apertures 21 in the door frame 20 thereby securing said door in a closed position relative to the door frame 20. The means for locking the pinion gear includes a pinion gear locking member 25 reversibly engageable between the teeth 29 of the pinion gear 24 by means of locking assembly 27.

Figure 6:
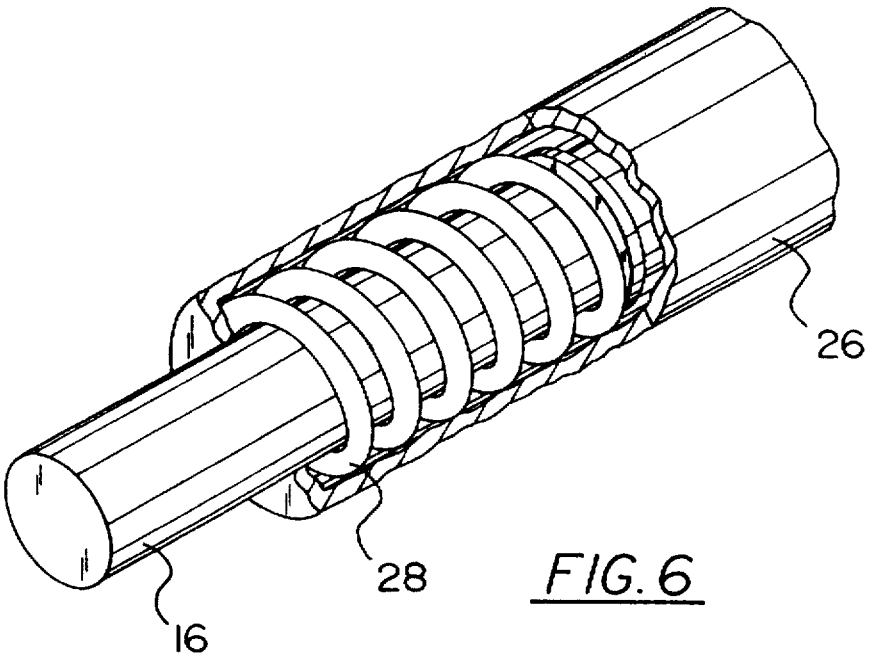
FIG. 6 is an exploded view of a locking arm.

FIG. 6 shows one of four locking arm assemblies including the locking arm 14, a guide tube 26 through which the locking arm 14 moves and a spring 28 which is a biasing means for keeping the inside ends 15 of the locking arms 14 in contact with the piston 12.

In use, the door 10 is unlocked by disengaging the pinion gear locking member 25 from the pinion gear 24. The doorknob 18 is then turned thereby causing the piston 12 to move and the locking arms 14 to extend through the apertures 21 in the door frame 20 into the structural framing or block.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the united states is as follows:

1. A security door replacement comprising:

a door member for mounting in a door frame having peripheral edges;

an elongated piston mounted in the interior of said door member, said piston being oriented substantially parallel to a longitudinal axis of said door member, said piston being mounted in a manner permitting longitudinal sliding movement of said piston in said door member, said piston having narrow portions and substantially wedge-shaped portions thereon wherein, the width of said piston is flared outwardly to form said wedge-shaped portions;

actuatable means for causing longitudinal sliding movement of said piston in said door member; and locking arms mounted in the interior of said door member and extending laterally outward from said piston, each of said locking arms having an inside end and an outside end, said locking arms oriented perpendicular to said piston, said locking arms being mounted in a manner permitting movement of said locking arms in a lateral direction relative to said door member such that said outside end of each of said locking arms may move out through a respective aperture provided in said peripheral edges of said door member and through a respective aperture formed in said door frame, said inside end of each of said locking arms being positioned to interact with a respective one of said wedge-shaped portions of said piston such that sliding longitudinal motion of the piston results in lateral inward and outward motion of each of said locking arms, wherein actuation of said actuatable means produces selective outward movement of said outside end of each of said locking arms into engagement with and extension through a respective aperture formed in said door frame to thereby secure said door member in a closed position with respect to said door frame.

2. The security door replacement of claim 1, wherein said piston is substantially centrally located and each of said wedge-shaped portions of said piston engage the inside ends of a pair of said locking arms with each one of said pair of locking arms positioned on each side of said piston.

3. The security door replacement of claim 2, further comprising a guide tube through which each said locking arm moves, and wherein said locking arms are biased so said inside ends ride against said piston such that motion of the piston causes lateral movement of said locking arms as said inside ends alternately engage the narrow portions of said piston and said wedge-shaped portions of said piston.

4. The security door replacement of claim 3, wherein said means for moving said piston comprises a rotatable pinion gear connected to a doorknob and a rack gear incorporated into said piston, said pinion gear engaging said rack gear such that rotation of said doorknob produces longitudinal movement of said piston.

5. The security door replacement of claim 4, further comprising a means for locking the pinion gear against rotation reversibly fixing said piston in position with the outside ends of said locking arms engaging and extending through the apertures in said door frame thereby securing said door member in a closed position relative to said door frame.

6. The security door replacement of claim 5, wherein said means for locking the pinion gear comprising a pinion gear locking member engageable between the teeth of said pinion gear by means of a locking assembly.

7. A security door replacement comprising:

a door member for mounting in a door frame, the door member having peripheral edges;

an elongated piston mounted in an interior of said door member, said piston being oriented substantially parallel to a longitudinal axis of said door member, said piston being mounted in a manner permitting longitudinal sliding movement of said piston within the interior of said door member;

a number of narrow portions integrally formed by said piston;

a number of substantially wedge-shaped portions integrally formed by said piston, wherein the width of said piston is flared outwardly to form said wedge-shaped portions;

actuatable means for causing longitudinal sliding movement of said piston in said door member;

locking arms mounted in the interior of said door member and extending laterally outward from said piston, each of said locking arms having an inside end and an outside end, said locking arms oriented perpendicular to said piston, said locking arms being mounted in a manner permitting movement of said locking arms in a lateral direction relative to said door member such that said outside end of each of said locking arms may move out through a respective aperture provided in said peripheral edges of said door member and through a respective aperture formed in said door frame, said inside end of each of said locking arms being positioned to interact with a respective one of said wedge-shaped portions of said piston such that sliding longitudinal motion of the piston results in lateral inward and outward motion of each of said locking arms, wherein actuation of said actuatable means produces selective outward movement of said outside end of each of said locking arms into engagement with and extension through a respective aperture formed in said door frame to thereby secure said door member in a closed position with respect to said door frame;

wherein said piston is substantially centrally located and each of said wedge-shaped portions of said piston engage the inside ends of a pair of said locking arms with each one of said pair of locking arms positioned on each side of said piston;

a guide tube through which each said locking arm moves, and wherein said locking arms are biased so said inside ends ride against said piston such that motion of the piston causes lateral movement of said locking arms as said inside ends alternately engage the narrow portions of said piston and said wedge-shaped portions of said piston;

wherein said means for moving said piston comprises a rotatable pinion gear connected to a doorknob and a rack gear incorporated into said piston, said pinion gear engaging said rack gear such that rotation of said doorknob produces longitudinal movement of said piston; and a means for locking the pinion gear against rotation reversibly fixing said piston in position with the outside ends of said locking arms engaging and extending through the apertures in said door frame thereby securing said door member in a closed position relative to said door frame; the means for locking the pinion gear having a pinion gear locking member engageable between the teeth of said pinion gear.

* * * * *